US005607047A

United States Patent [19]

Leet et al.

[11] Patent Number: 5,607,047

[45] Date of Patent: Mar. 4, 1997

[54] CIRCUIT BREAKER HOUSING

[75] Inventors: Edward Leet, Boksburg; Manuel F. V. Ribeiro, Germiston; Carlos A. Ferreira, Boksburg, all of South Africa

[73] Assignee: Circuit Breaker Industries Limited, South Africa

[21] Appl. No.: 590,000

[22] Filed: Jan. 23, 1996

Related U.S. Application Data

[63] Continuation of Ser. No. 235,385, Apr. 28, 1994, abandoned.

[30] Foreign Application Priority Data

Apr. 28, 1993 [ZA] South Africa ..... 93/2988

[51] Int. Cl.[6] ..... H01H 23/04

[52] U.S. Cl. ..... 200/303

[58] Field of Search ..... 200/303

[56] References Cited

U.S. PATENT DOCUMENTS

| | | | |
|---|---|---|---|
| 2,429,722 | 10/1947 | Jennings | 200/303 X |
| 2,934,623 | 4/1960 | Christensen . | |
| 4,071,720 | 1/1978 | Krajci et al. | 200/303 X |
| 4,527,027 | 7/1985 | Link et al. | 200/303 X |
| 4,623,861 | 11/1986 | Krasij et al. | 200/303 X |
| 4,760,226 | 7/1988 | Fasano | 200/303 |

FOREIGN PATENT DOCUMENTS

| | | |
|---|---|---|
| 0520914 | 12/1992 | European Pat. Off. . |
| 1588270 | 7/1970 | Germany . |

*Primary Examiner*—Renee S. Luebke
*Attorney, Agent, or Firm*—Ladas & Parry

[57] ABSTRACT

A modular housing for a circuit breaker has first and second opposed side panels which engage one another at respective upper and lower edges defined by transversely extending flanges. The mated flanges define the upper and lower edges of the housing. When assembled, the side panels define an enclosure with front and rear openings, with grooves on the inner edges of the openings which receive tongues of respective modular front and rear panels of the circuit breaker housing. The front panel has an opening through which an operating lever protrudes when the housing is assembled, and the operating lever pivots on formations on the inner surfaces of the side panels. The modular construction of the circuit breaker housing allows different front and rear panels to be fitted to a common shell. For example, a range of circuit breakers having different operating handles and different terminal configurations can be provided at a relatively low cost.

28 Claims, 4 Drawing Sheets

14
42
20
13
12
18
74
10
3
74
16
86
92
80
72
52
70
78
28
24
40
26
88
34
46
38
90
54
62
44
122
124
48
50
66
76
82
84
68
32
30
22
54
58
124
60
64
56

Fig 6
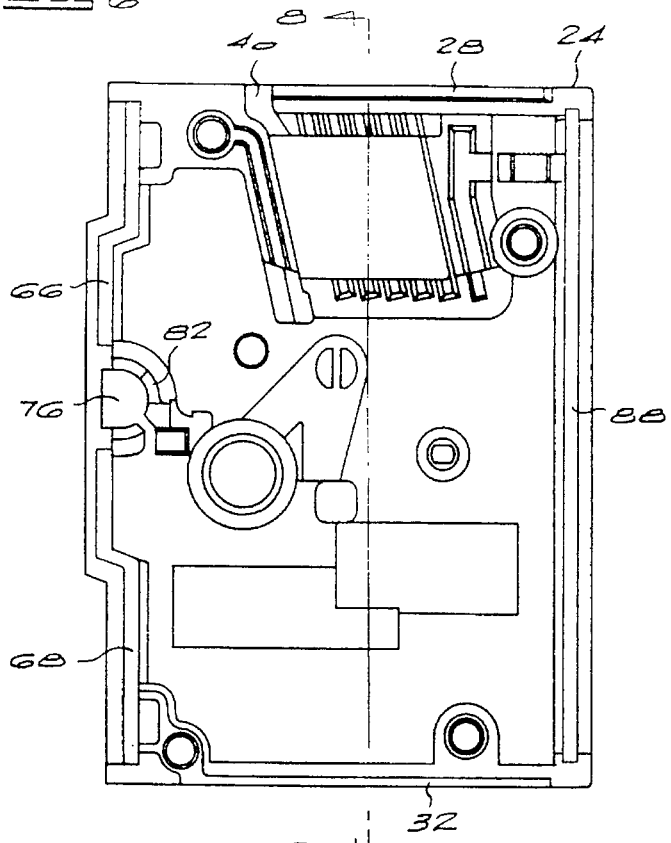
Fig 7
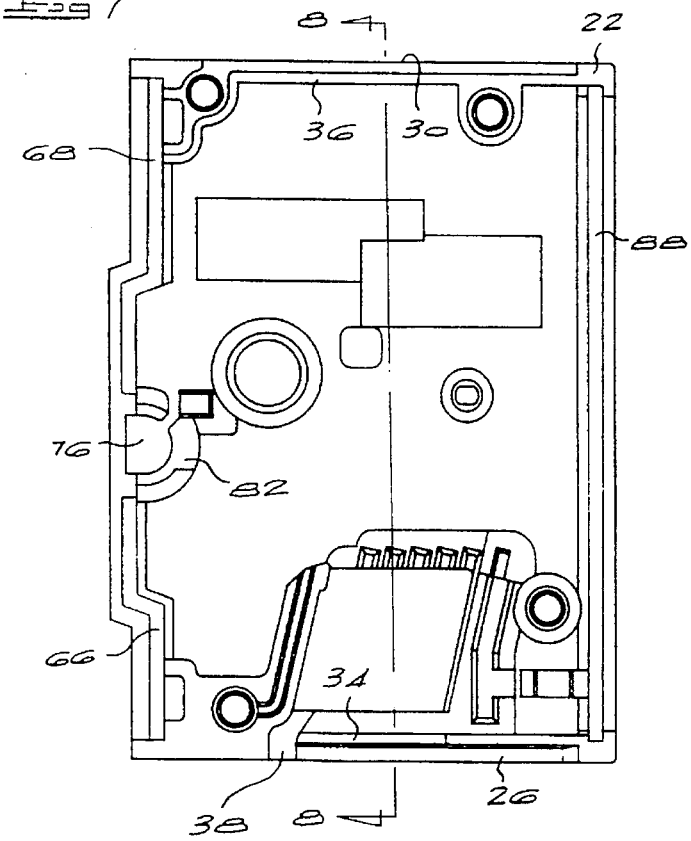
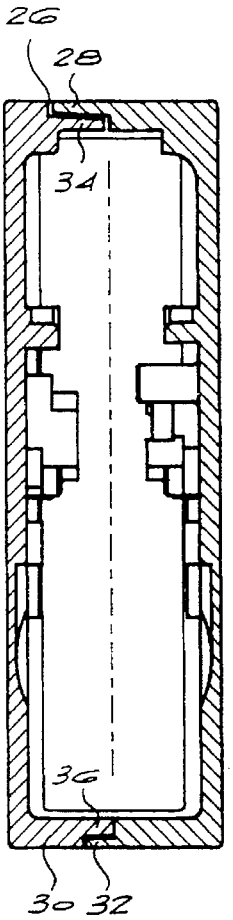
Fig 8

Fig 9
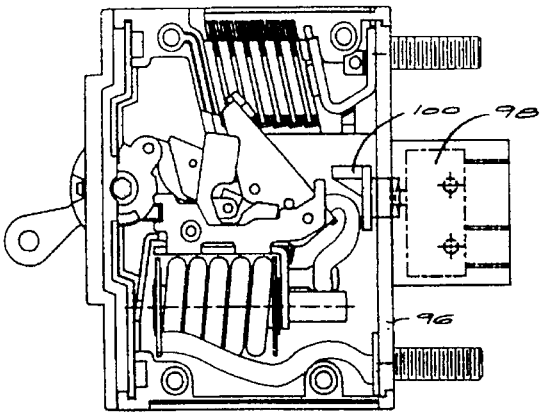
Fig 11
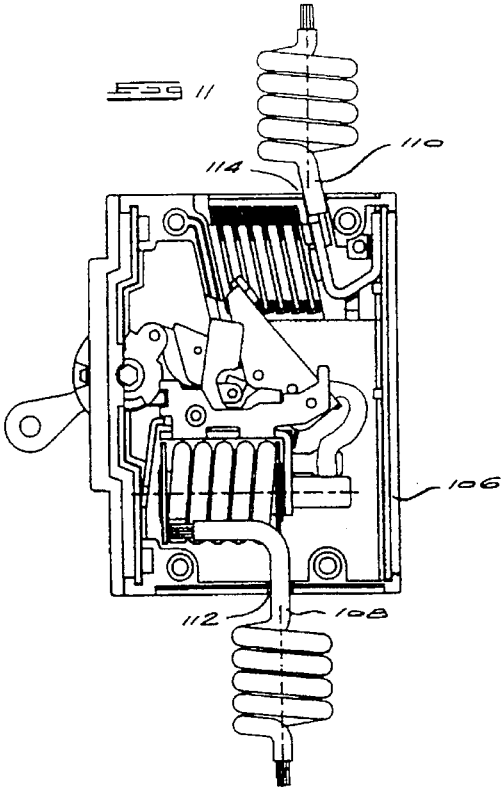
Fig 10
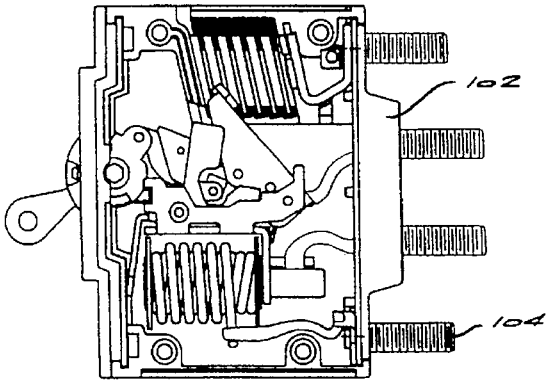
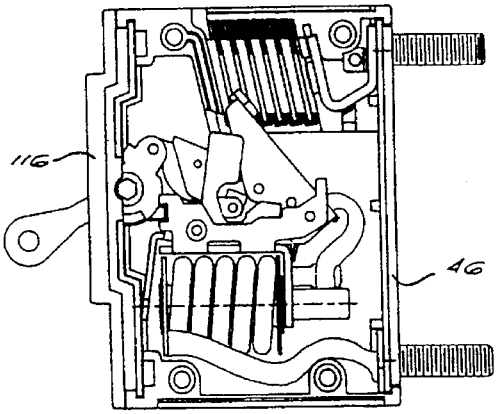
Fig 12
Fig 13
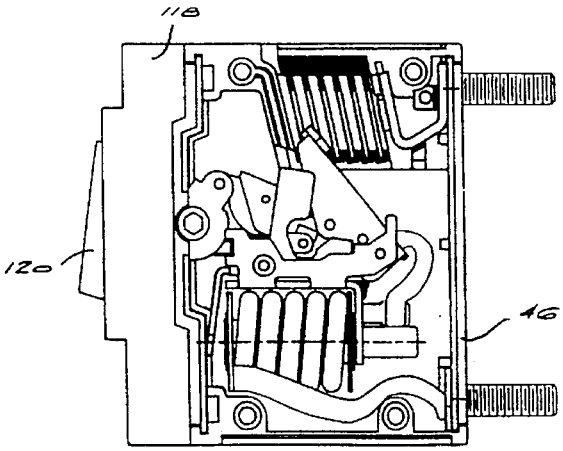

CIRCUIT BREAKER HOUSING

This is a continuation of application Ser. No. 08/235,385 filed on Apr. 28, 1994 and now abandoned.

BACKGROUND OF THE INVENTION

1. Field of the Invention

This invention relates to a circuit breaker with a modular housing.

2. Description of the Related Art

Numerous different circuit breaker designs can be found in the prior art. For example, a circuit breaker may include a front panel having a rocker-type switch or toggle-type switch and a rear panel having any number of terminal leads or studs.

The circuit breaker designs in the prior art often employ split case housings; however, given the numerous front and rear panel configurations, conventional split case housings may not be a cost effective design alternative as each circuit breaker having a different front and rear panel configuration may require a new housing design. Substantial tooling costs may be incurred with each circuit breaker design modification. Therefore, there is a need in the art for a modular housing for a circuit breaker that accommodates different circuit breaker configurations.

SUMMARY OF THE INVENTION

The invention provides for a modular circuit breaker housing suitable for a wide variety of different circuit breaker configurations. The housing is arranged so that a standard circuit breaker shell or housing is provided, which can have any one of a number of different front and rear panels fitted to it, with different appearances, functions or terminal configurations.

This circuit breaker housing arrangement provides a number of practical advantages over the circuit breaker housing known in the art. The use of a number of different front and rear panels greatly reduces the tooling cost of providing a variety of different circuit breakers in a single range. Generally, only the front and/or rear panels need be changed, according to requirements. Because the side panels and the front and rear panels are independent, it is possible to use different types or grades of material for the panels. It is also possible to produce panels with different colors to aid in identifying the type of circuit connected to the unit. In addition, the rear panels allow for better retention of the terminal studs, compared to circuit breaker arrangements in which the studs are held between two halves of a split casing.

According to the invention there is provided a modular housing for a circuit breaker, the housing having opposed side surfaces, opposed top and bottom surfaces, and opposed front and rear surfaces, and comprising:

first and second opposed side panels adapted to engage one another at respective opposed upper and lower edges and to define an enclosure for the circuit breaker mechanism with openings at the front and rear thereof, so that the side panels define the opposed side surfaces of the housing and the engaged upper and lower edges define the top and bottom surfaces;

a modular front panel securable in the opening at the front of the enclosure to define the front surface of the housing; and a modular rear panel securable in the opening at the rear of the enclosure to define the rear surface of the housing.

Each one of the first and second side panels may have transversely extending flanges formed at the respective opposed upper and lower edges thereof arranged to mate with respective opposed flanges of the other side panel, the flanges being formed with complementary engaging formations at their edges.

The outermost edge of each flange may be formed with an edge zone of reduced thickness, so that the mating edges of opposed flanges overlap.

Each side panel may have engaging formations formed on its inner front and rear edges for engagement with complementary formations on the edges of the modular front and rear panels, to retain the front and rear panels in position.

Preferably, the engaging formations on the inner front and rear edges of the side panels are grooves, and the complementary formations on the edges of the front and rear panels are tongues.

Each side panel may have a retaining formation formed on an inner surface thereof, adjacent to a front edge thereof, for receiving a projection of an operating lever of the circuit breaker so that the lever is retained pivotably in the housing between the retaining formations.

The modular front panel may have an opening therein through which the operating lever protrudes when the housing is assembled.

Preferably, the side panels, the front panel and the rear panel are molded from a tough plastics material.

At least one of the front panel and the rear panel may be formed from a material which is different from the material from which the side panels are formed.

At least one of the front panel and the rear panel may be formed with a different color from that of the side panels.

BRIEF DESCRIPTION OF THE DRAWINGS

FIG. 6 is a similar view to that of FIG. 5, showing an interior side view of the left side panel of the circuit breaker housing with the circuit breaker mechanism removed;

FIG. 7 is an interior side view of the right side panel of the circuit breaker housing;

FIG. 8 is a cross section of the assembled housing on the line 8—8 in FIGS. 6 and 7; and FIG. 9 is a side view, similar to that of FIG. 5, of a first alternative embodiment of the invention;

FIG. 10 is a side view, similar to that of FIG. 5, of a second alternative embodiment of the invention;

FIG. 11 is a side view, similar to that of FIG. 5, of a third alternative embodiment of the invention;

FIG. 12 is a side view, similar to that of FIG. 5, of a fourth alternative embodiment of the invention; and FIG. 13 is a side view, similar to that of FIG. 5, of a fifth alternative embodiment of the invention;

DESCRIPTION OF EMBODIMENTS

Figures 1, 2:
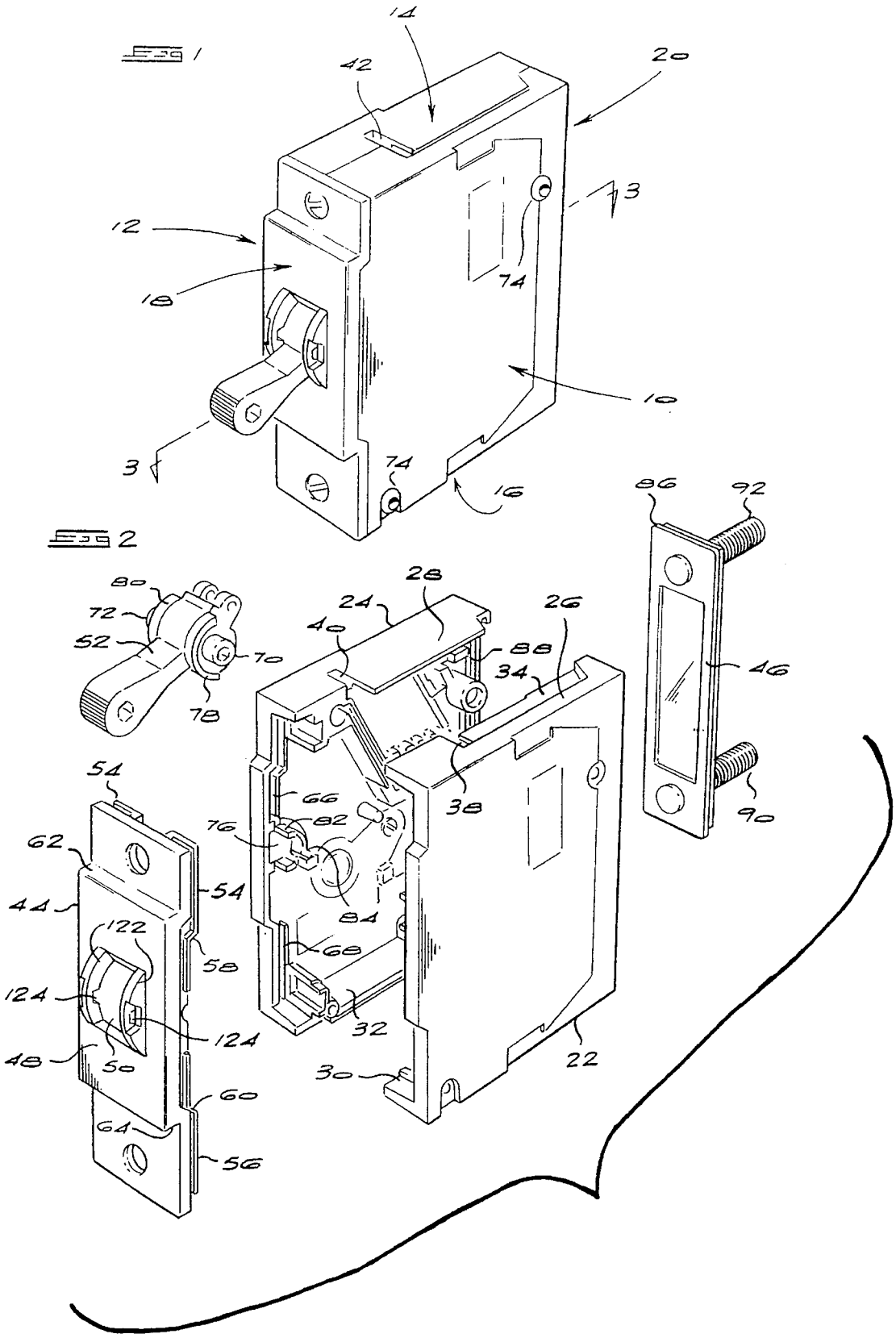
FIG. 1 is a pictorial view of modular housing for a circuit breaker according to the invention, in an assembled condition.
FIG. 2 is an exploded pictorial view of the housing of FIG. 1, showing its main components.

FIG. 1 shows a modular circuit breaker housing according to the invention, in an assembled condition. The housing is generally parallelepipedic in shape, with opposed major side surfaces 10 and 12, opposed top and bottom surfaces 14 and 16, and opposed front and rear surfaces 18 and 20, so that the circuit breaker housing has a generally conventional shape.

The individual components of the circuit breaker housing are shown more clearly in FIG. 2, and include first and second side panels 22 and 24, which have generally planar major surfaces which define the opposed side surfaces 10 and 12 of the housing respectively. At the respective upper and lower edges of the side panels 22 and 24 are transversely inwardly extending flanges 26, 28 and 30, 32 which are shaped complementally and which engage one another to define overlapping joints when the side panels are assembled. The top surface 14 of the housing is defined by the mated flanges 26 and 28, while the bottom surface 16 is defined by the mated flanges 30 and 32.

The cross-sectional view of FIG. 8 shows how the flanges 26 and 30 on the panel 22 have recessed portions 34 and 36 formed therein which receive complementally shaped outer portions with reduced thickness of the flanges 28 and 32 of the other side panel 24. Notches 38 and 40 are formed in the respective flanges 26 and 28, which are aligned to form an exhaust slot 42 in the upper side surface 14 of the assembled housing, adjacent an arc extinguishing device within the housing.

The enclosure formed by the joined side panels 22 and 24 defines rectangular front and rear openings which are filled by respective front and rear panels 44 and 46. The front and rear panels are formed with tongues on their edges which fit into grooves formed in the inner front and rear edges of the side panels, adjacent the front and rear openings, so that when the side panels are fitted together and secured by means of rivets 74 or other fasteners, the front and rear panels are securely held in place. When the circuit breaker housing is assembled, the front and rear panels of the housing define at least a major portion of the front and rear surfaces of the housing, i.e., at least 50% of the front and rear surfaces of the housing are defined by the front and rear panels.

Figure 3:
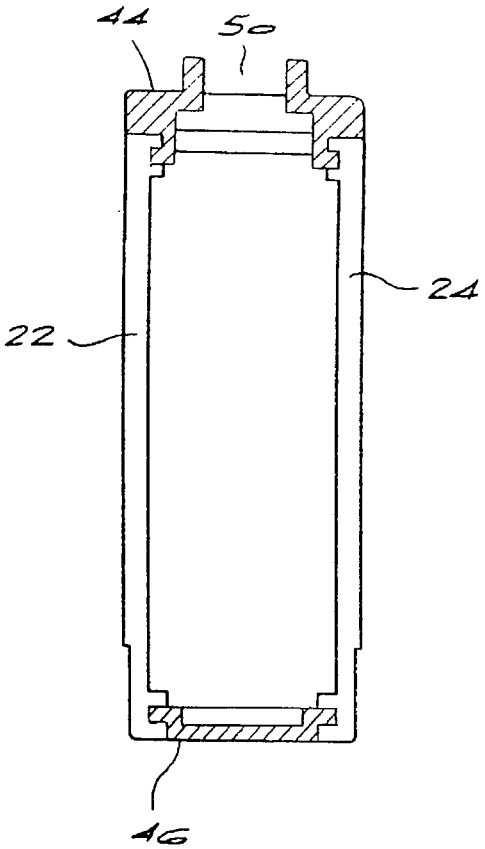
FIG. 3 is a diagrammatic partial sectional view of the housing on the line 3—3 in FIG. 1.
Figure 4:
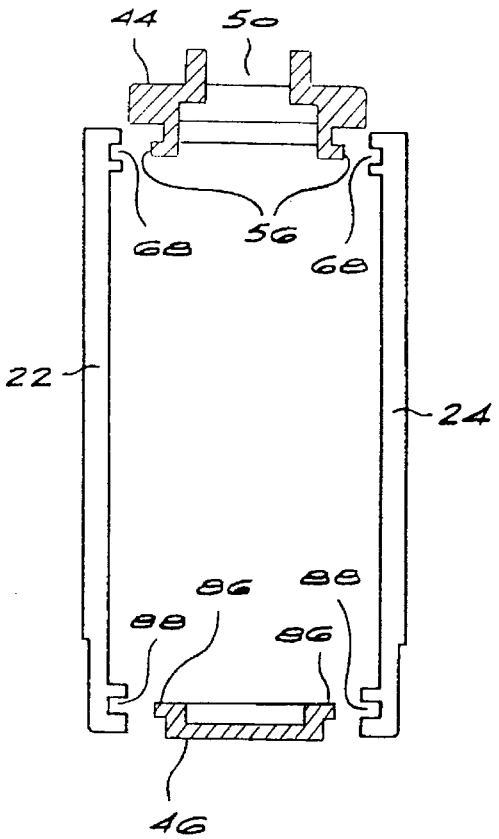
FIG. 4 is a similar view to that of FIG. 3, with the components of the housing exploded.

The sectional views of FIGS. 3 and 4 show the tongue and groove fitting between the front and rear panels 44 and 46 and the side panels 22 and 24 more clearly.

The front panel 44 has a raised central portion 48 with an opening 50 shaped to receive an operating lever 52 of the circuit breaker mechanism. Along the long edges of the front panel, tongues 54 and 56 are formed on either side, which have respective steps or shoulders 58 and 60 formed therein, adjacent to steps 62 and 64 at each end of the raised central portion 48.

Complementally shaped grooves 66 and 68 on the inner front edges of the side panels 22 and 24 receive the respective tongues of the front panel 44, so that the front panel is located positively between the side panels when they are assembled.

The operating lever 52 is formed with projections 70 and 72 which define a spindle for the lever, which are received in cavities 76 located between the facing inner ends of the grooves 66 and 68 in each side panel. Curved flanges 78 and 80 adjacent the projections 70 and 72 engage upstanding curved walls 82 which define the cavities 76, and engage molded stops 84 which limit the travel of the lever in use. Like the front panel 44, the operating lever 52 is simply retained between the two side panels when the latter are assembled, with the cavities 76 serving as sockets for the projections 70 and 72 of the lever.

The rear panel 46 shown in FIG. 2 is generally flat and rectangular, with a tongue 86 extending about its periphery which is received in grooves 88 in the inner rear edges of the side panels 22 and 24. The rear panel carries electrical line and load screw terminals 90 and 92, which are connected electrically to a circuit breaker mechanism in use.

On either side of the opening 50 in the front panel 44 are upstanding part-circular flanges 122, which are formed with central apertures 124 through which a suitable sized locking member or seal can be passed, allowing the operating lever 52 to be sealed in an "on" or an "off" position of the circuit breaker.

The result of the above described arrangement is that a standard circuit breaker shell or housing is provided, which can have any one of a number of different front and rear panels fitted to it, with different appearances, functions or terminal configurations, for example. This greatly reduces the tooling cost of providing a variety of different circuit breakers in a single range. Generally, only the front and/or rear panel need be changed, according to requirements.

Figure 5:
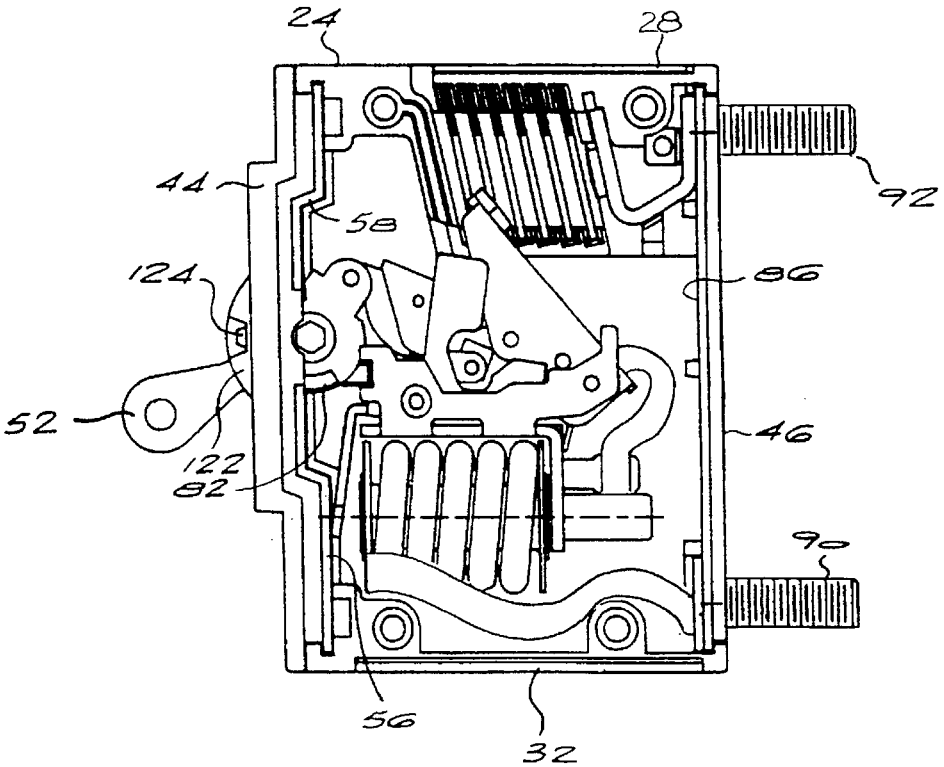
FIG. 5 is a side view of a first embodiment of a circuit breaker according to the invention, with one side panel removed.

Referring now to FIG. 5, the illustrated circuit breaker has the modular housing described above. The line and load terminals 90 and 92 of the modular rear panel 46 are connected to a circuit breaker mechanism inside the housing. The operating lever 52 is arranged as a toggle switch for controlling the circuit breaker mechanism.

FIGS. 9 to 13 illustrate a number of further embodiments which exploit the modularity of the described housing arrangement.

The circuit breaker of FIG. 9 is similar to that of FIG. 5, except that it is fitted with a modular rear panel 96 which is formed with an integral microswitch 98 with an actuator member 100 which extends through the rear panel to engage the circuit breaker mechanism when the latter is operated.

The circuit breaker of FIG. 10 is again similar to that of FIG. 5, except that is has a modular rear panel 102 which is fitted with four terminal studs 104, allowing the connection of an auxiliary current measuring device or the like.

The circuit breaker of FIG. 11 is different from that of FIG. 5 in that it has a completely blank rear panel 106 with no terminals or openings at all, and connections to the circuit breaker mechanism are made via leads 108 and 110 which pass through openings 112 and 114 in the side panels of the circuit breaker.

The embodiment of FIG. 12 is similar to that of FIG. 5, with a similar two-terminal rear panel 46, but has a standard (non-sealable) front panel 116.

Finally, the circuit breaker of FIG. 13 also has a two-terminal rear panel 46 like the embodiments of FIGS. 5 and 12, but has a front panel 118 which carries a rocker-type switch 120 instead of a lever or toggle-type switch.

It will be apparent that the described modular housing arrangement allows a wide variety of different circuit breaker configurations to be provided, with a minimum of different housing components being required.

A number of practical advantages are obtained by the described arrangement. Because the side panels and the front and rear panels are completely independent, it is possible to use different types or grades of material for these panels.

Normally, the panels will be molded from a tough plastics material with suitable electrical properties. Similarly, it is possible to produce panels with different colors, and different front and rear panels can be color coded to identify the type of circuit connected to the unit. In the case of the rear panels, better retention of the terminal studs is obtained, compared to an arrangement in which the studs are held between two halves of a split casing.

We claim:

1. A modular housing for a circuit breaker, the housing having opposed side surfaces, opposed top and bottom surfaces, and opposed front and rear surfaces, and comprising:

first and second opposed side panels adapted to engage one another at respective opposed upper and lower edges and to define an enclosure for a circuit breaker mechanism with openings at the front and rear thereof, so that the side panels define the opposed side surfaces of the housing and the engaged upper and lower edges define the top and bottom surfaces;

a modular front panel selected from a plurality of different front panels and securable in the opening at the front of the enclosure to define at least a major portion of the front surface of the housing; and a modular rear panel selected from a plurality of different rear panels and securable in the opening at the rear of the enclosure to define at least a major portion of the rear surface of the housing.

2. A modular housing according to claim 1 wherein each one of the first and second side panels has transversely extending flanges formed at the respective opposed upper and lower edges thereof arranged to mate with respective opposed flanges of the other side panel, the flanges being formed with complementary engaging formations at their edges.

3. A modular housing according to claim 2 wherein the outermost edge of each flange is formed with an edge zone of reduced thickness, so that the mating edges of opposed flanges overlap.

4. A modular housing according to claim 2 wherein each side panel has engaging formations formed on its inner front and rear edges for engagement with complementary formations on the edges of the modular front and rear panels, to retain the front and rear panels in position.

5. A modular housing according to claim 4 wherein the engaging formations on the inner front and rear edges of the side panels are grooves, and the complementary formations on the edges of the front and rear panels are tongues.

6. A modular housing according to claim 1 wherein each side panel has a retaining formation formed on an inner surface thereof, adjacent to a front edge thereof, for receiving a projection of an operating lever of the circuit breaker so that the lever is retained pivotably in the housing between the retaining formations.

7. A modular housing according to claim 6 wherein the modular front panel has an opening therein through which the operating lever protrudes when the housing is assembled.

8. A modular housing according to claim 1 wherein the side panels, the front panel and the rear panel are molded from a tough plastics material.

9. A modular housing according to claim 1 wherein at least one of the front panel and the rear panel is formed from a material which is different from a material from which the side panels are formed.

10. A modular housing according to claim 1 wherein at least one of the front panel and the rear panel is formed with a different color from that of the side panels.

11. A modular housing for a circuit breaker, the housing having opposed side surfaces, opposed top and bottom surfaces, and opposed front and rear surfaces, and comprising:

first and second opposed side panels adapted to engage one another at respective opposed upper and lower edges and to define an enclosure for a circuit breaker mechanism with openings at the front and rear thereof, so that the side panels define the opposed side surfaces of the housing and the engaged upper and lower edges define the top and bottom surfaces;

a modular front panel securable in the opening at the front of the enclosure to define the front surface of the housing; and a modular rear panel securable in the opening at the rear of the enclosure to define the rear surface of the housing, wherein each one of the first and second side panels has transversely extending flanges formed at the respective opposed upper and lower edges thereof arranged to mate with respective opposed flanges of the other side panel, the flanges being formed with complementary engaging formations at their edges, and wherein each side panel has engaging formations formed on its inner front and rear edges for engagement with complementary formations on the edges of the modular front and rear panels, to retain the front and rear panels in position.

12. A modular housing according to claim 11 wherein the outermost edge of each flange is formed with an edge zone of reduced thickness, so that the mating edges of opposed flanges overlap.

13. A modular housing according to claim 11 wherein the engaging formations on the inner front and rear edges of the side panels are grooves, and the complementary formations on the edges of the front and rear panels are tongues.

14. A modular housing according to claim 11 wherein the side panels, the front panel and the rear panel are molded from a tough plastics material.

15. A modular housing according to claim 11 wherein at least one of the front panel and the rear panel is formed from a material which is different from a material from which the side panels are formed.

16. A modular housing according to claim 11 wherein at least one of the front panel and the rear panel is formed with a different color from that of the side panels.

17. A modular housing for a circuit breaker, the housing having opposed side surfaces, opposed top and bottom surfaces, and opposed front and rear surfaces, and comprising:

first and second opposed side panels adapted to engage one another at respective opposed upper and lower edges and to define an enclosure for a circuit breaker mechanism with openings at the front and rear thereof, so that the side panels define the opposed side surfaces of the housing and the engaged upper and lower edges define the top and bottom surfaces;

a modular front panel securable in the opening at the front of the enclosure to define the front surface of the housing; and a modular rear panel securable in the opening at the rear of the enclosure to define the rear surface of the housing, wherein, each side panel has a retaining formation formed on an inner surface thereof, adjacent to a front edge thereof, for receiving a projection of an operating lever of the circuit breaker so that the lever is retained pivotably in the housing between the retaining formations.

18. A modular housing according to claim 17 wherein the modular front panel has an opening therein through which the operating lever protrudes when the housing is assembled.

19. A modular housing for a circuit breaker, the housing having opposed side surfaces, opposed top and bottom surfaces, and opposed front and rear surfaces, and comprising first and second opposed side panels adapted to engage one another at respective opposed upper and lower edges and to define an enclosure for a circuit breaker mechanism with openings at the front and rear thereof, so that the side panels define the opposed side surfaces of the housing and the engaged upper and lower edges define the top and bottom surfaces and that the front and rear openings are respectively defined by the two opposed side surfaces and the top and bottom surfaces; a modular front panel selected from a plurality of different front panels and securable in the front opening at the front of the enclosure so as to cover the front opening and to define at least a major portion of the front surface of the housing; and a modular rear panel selected from a plurality of different rear panels and securable in the opening at the rear of the enclosure so as to cover the rear opening and to define at least a major portion of the rear surface of the housing.

20. A modular housing according to claim 19 wherein each of one the first and second side panels has transversely extending flanges formed at the respective opposed upper and lower edges thereof arranged to mate with respective opposed flanges of the other side panel, the flanges being formed with complementary engaging formations at their edges.

21. A modular housing according to claim 20 wherein the outermost edge of each flange is formed with an edge zone of reduced thickness, so that the mating edges of opposed flanges overlap.

22. A modular housing according to claim 20 wherein each side panel has engaging formations formed on its inner front and rear edges for engagement with complementary formations on the edges of the modular front and rear panels, to retain the front and rear panels in position.

23. A modular housing according to claim 22 wherein the engaging formations on the inner front and rear edges of the side panels are grooves, and the complementary formations on the edges of the front and rear panels are tongues.

24. A modular housing according to claim 19 wherein each side panel has a retaining formation on an inner surface thereof, adjacent to a front edge thereof, for receiving a projection of an operating lever of the circuit breaker so that the lever is retained pivotably in the housing between the retaining formations.

25. A modular housing according to claim 24 wherein the modular front panel has an opening therein through which the operating lever protrudes when the housing is assembled.

26. A modular housing according to claim 19 wherein the side panels, the front panel and the rear panel are molded from a tough plastics material.

27. A modular housing according to claim 19 wherein at least one of the front panel and the rear panel is formed from a material which is different from a material front which the side panels are formed.

28. A modular housing according to claim 19 wherein at least one of the front panel and the rear panel is formed with a different color from that of the side panels.

* * * * *